US006574998B2

(12) United States Patent
Kwon

(10) Patent No.: US 6,574,998 B2
(45) Date of Patent: Jun. 10, 2003

(54) HANDCUFFS

(76) Inventor: Jeong-Su Kwon, EUNMA Apt. 30-705, 316, Daechi-Dong, Kangnam-Ku, Seoul (KR)

( * ) Notice: Subject to any disclaimer, the term of this patent is extended or adjusted under 35 U.S.C. 154(b) by 0 days.

(21) Appl. No.: 10/157,849

(22) Filed: May 31, 2002

(65) Prior Publication Data

US 2002/0189303 A1 Dec. 19, 2002

(30) Foreign Application Priority Data

Jun. 18, 2001 (KR) ..... 2001/18112

(51) Int. Cl.[7] ..... E05B 75/00
(52) U.S. Cl. ..... 70/16; 70/419
(58) Field of Search ..... 70/15–19, 419

(56) References Cited

U.S. PATENT DOCUMENTS 308,075 A * 11/1884 Johnson
1,775,727 A * 9/1930 Latou
1,900,242 A * 3/1933 Latou
2,390,885 A * 12/1945 Kelley
2,570,662 A * 10/1951 Gray
3,146,614 A * 9/1964 Von Frantzius

FOREIGN PATENT DOCUMENTS

GB 2168417 * 6/1986 ..... 70/16

* cited by examiner

*Primary Examiner*—Lloyd A. Gall
(74) *Attorney, Agent, or Firm*—Arent Fox Kintner Plotkin & Kahn

(57) ABSTRACT

A handcuff adapted to guide an inserted foreign metal piece upwardly to a blocking portion, and to be quickly put on a wrist of a criminal person is disclosed. The handcuff includes: a movable arm having a ratchet portion formed with teeth; a pair of fixed arms pivotably connected to the movable arm by a pivot pin and integrally provided with rectangular base bodies; a partition plate disposed between the pair of base bodies of the fixed arms, and provided with bilaterally bent protrusions; a pair of frame plates disposed between the fixed arms and the partition plate, and provided with upwardly inclined surfaces and blocking protrusions; a pair of pawl pieces biasedly supported in the pair of frame plates, and provided with teeth to be engaged with the teeth of the movable arm; and a leaf spring received in the pair of frame plates to bias the pair of pawl pieces toward the movable arm. The most proximal teeth of the teeth include slanting surfaces. When the movable arm is pulled out of the fixed arms, the innermost teeth of the teeth pass over the most proximal teeth of the movable arm, thereby maintaining engagement between the innermost teeth of the pawl pieces and the most proximal teeth of the movable arm.

2 Claims, 5 Drawing Sheets

HANDCUFFS

BACKGROUND OF THE INVENTION

1. Field of the Invention

The present invention relates to handcuffs which cannot be picked by a foreign object such as a steel wire other than an associated key, and more particularly to handcuffs which are adapted to guide a foreign object inserted into a passageway to a protrusion preventing the foreign object from reaching a ratchet portion of a movable arm, and which is adapted to quickly disable an arrested person by permitting the movable arm to be quickly released from its engaged position.

2. Description of the Prior Art

Various kinds of handcuffs have been proposed up to now. Such prior art handcuffs are designed to be locked by inserting several locking pins thereinto from the outside. Therefore, the prior art handcuffs are easily unlocked in such a way that the handcuffs are applied with sufficient force to pull the locking pins out of the handcuffs and thus to allow its movable arms and fixed arms to be disengaged. Furthermore, since the prior art handcuffs have movable arms pivotably connected to fixed arms by pivot pins, the movable arms are easily released from the fixed arms by breakage or separation of the pivot pins. In addition, the prior art handcuffs may be easily unlocked in such a way that a fine pin such as a hairpin is inserted into the handcuff to displace a movable arm.

To overcome these problems, various handcuffs are proposed as disclosed in Korean Utility Model Publication Nos. 1993-204, 1993-2996 and 1996-3984. In particular, handcuffs, which are adapted to more easily put handcuffs on a criminal and to prevent unlocking by a foreign metal object, have been proposed.

In the known handcuffs, a movable arm is maintained in the locked position in such a way that a ratchet portion of the movable arm is inserted into a base body of a fixed arm through a passageway defined in the fixed arm and teeth of the ratchet portion are engaged with teeth of a pawl piece. In this state, the teeth of the ratchet portion are engaged with the teeth of the elastically supported pawl piece.

Since the pawl piece is elastically supported, if a metal piece having a thickness of 0.1 to 0.2 mm is inserted between the teeth of the movable arm and the teeth of pawl piece, the teeth of the movable arm are moved along the foreign metal piece in a direction opposite to the insertion direction and thus released from the pawl piece. Hence, such conventional handcuffs cannot prevent unwanted unlocking by foreign metal object.

To overcome this problem, handcuffs have been proposed by the inventor, which are provided with a partition plate disposed between a pair of pawl pieces wherein the partition plate includes bilaterally bent inclined protrusions to prevent a foreign thin metal piece from being inserted thereinto. In addition to the above handcuffs, the handcuffs may be provided with means for guiding a foreign metal piece to a constraining portion.

In general, when a user carries handcuffs on him, movable arms are inserted into a base bodies and teeth of the movable arms are engaged with teeth of pawl pieces. When the user arrests a criminal with the handcuffs, the user strikes the movable arm against a wrist of the criminal. By this impact, the movable arm is rotated in its insertion direction and then inserted into a passageway of the fixed arm, so that teeth of the movable arm are engaged with teeth of the pawl piece. However, since the teeth of the movable arm must pass over the teeth of the pawl piece while being in contact with the teeth of the elastically supported pawl piece, a time period required to complete the passage of the movable arm through the fixed arm is relatively long. Therefore, a user cannot achieve a prompt arrest of a criminal.

SUMMARY OF THE INVENTION

Accordingly, the present invention has been made keeping in mind the above problems occurring in the prior art and the prior handcuffs proposed by the inventor, and an object of the present invention is to provide a handcuff which is adapted to guide a foreign metal piece inserted thereinto upwardly to a blocking portion, thereby preventing an unwanted insertion of a foreign metal object.

Another object of the present invention is to provide a handcuff which is adapted to be quickly put on a wrist of a criminal.

In order to accomplish the above object, the present invention provides a handcuff comprising: a movable arm formed into a "C" shape, which is provided at its free end with a ratchet portion formed with dual lines of teeth; a pair of fixed arms formed into a "C" shape, which are pivotably connected at free ends thereof to the other end of the movable arm by a pivot pin and are integrally provided at their other ends with rectangular base bodies; a partition plate interposed between the pair of base bodies of the fixed arms to define a passageway allowing the movable arm to pass therethrough, and having a central reception cut portion, and which is provided with a dividing protrusion and bilaterally bent protrusions at an inlet of the passageway; a pair of frame plates disposed between the pair of base bodies of the fixed arms and the partition plate, each of the frame plates having a reception cut portion, and which are provided with upwardly inclined surfaces and blocking protrusions at the inlet of the passageway such that a gap is defined between the bilaterally bent protrusions of the partition plate and the upwardly inclined surfaces, thereby guiding a foreign metal object inserted into the passageway to the blocking protrusions through the gap; a pair of pawl pieces biasedly supported in the reception cut portions of the pair of frame plates, and which are provided at their free ends with teeth to be engaged with the teeth of the movable arm; and a leaf spring received in the reception cut portions of the pair of frame plates to bias the pair of pawl pieces toward the ratchet portion of the movable arm.

Preferably, the most proximal teeth of the teeth are formed with slanting surfaces for causing the proximal teeth to have an obtuse angle at their apex, whereby when the movable arm is pulled out of the base bodies of the fixed arms, the innermost teeth of the teeth pass over the most proximal teeth of the movable arm, thereby maintaining engagement between the innermost teeth of the pawl pieces and the most proximal teeth of the movable arm.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE INVENTION

This invention will be described in further detail by way of example with reference to the accompanying drawings.

Figure 1:
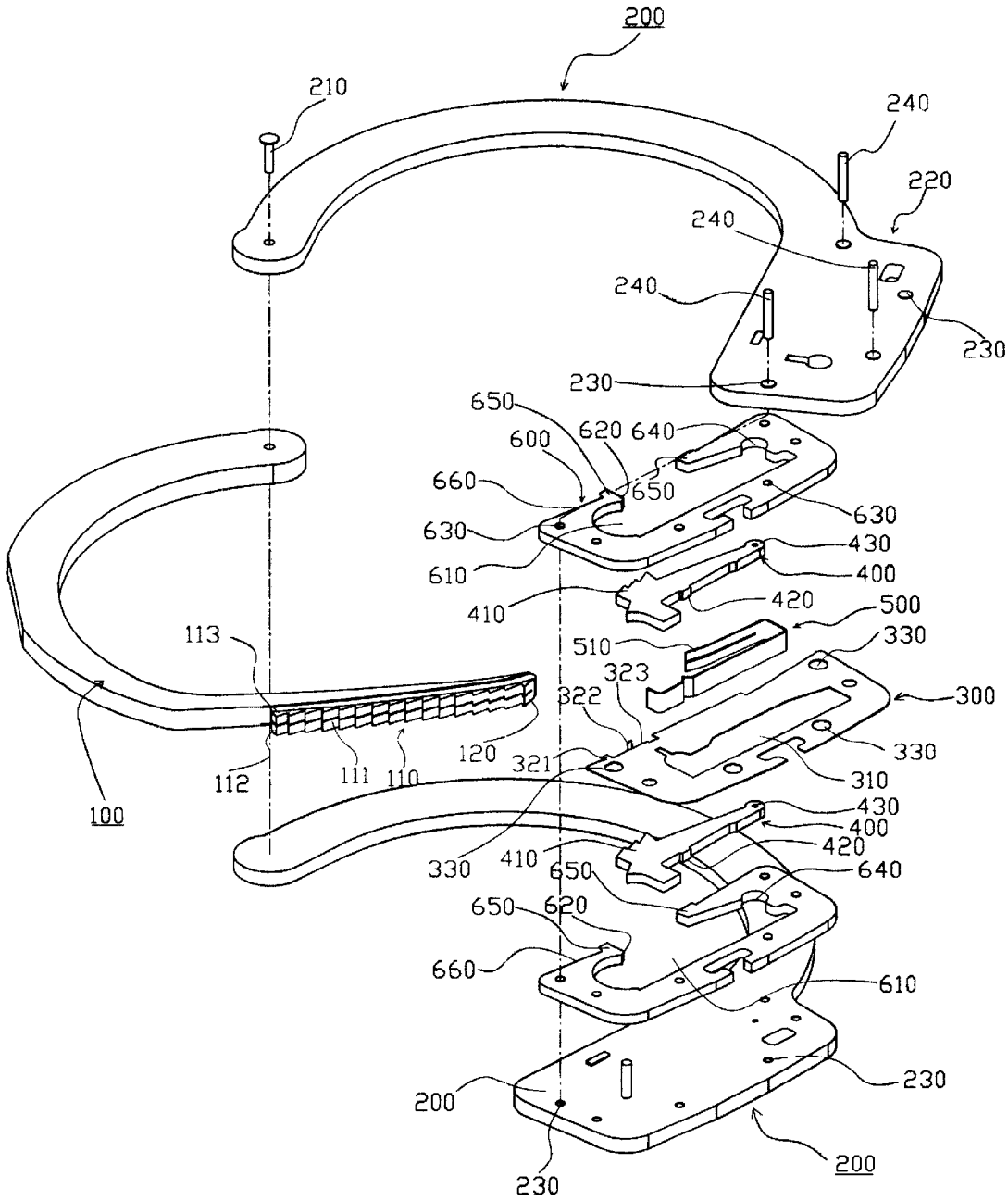
FIG. 1 is an exploded perspective view of a handcuff according to the present invention.

As shown in FIG. 1, a handcuff according to the present invention comprises a movable arm 100, a pair of fixed arms 200, a partition plate 300, pawl pieces 400, a leaf spring 500 and frame plates 600.

The C-shaped movable arm 100 is provided at an outer surface of its free end with a ratchet portion consisting of dual lines of teeth. The ratchet portion 110 is formed with a longitudinal partition groove 120 between the dual line of teeth so that the movable arm 100 is guided by sliding of the partition groove 120 on an elongated guide protrusion 320 and a dividing protrusion 321 of the partition plate 300 as described hereinafter.

The movable arm 100 is pivotably connected at the other end to free ends of the fixed arms 200 by a pivot pin 210, so that the movable arm 100 can be rotated about the pivot pin 210.

Similarly to the movable arm 100, each of the fixed arms 200 is formed to have a C shape. The fixed arms 200 are connected at their ends to the movable arm 100 by the pivot pin 210, as described above, and are integrally formed at the other ends with rectangular base bodies 220.

Figure 3:
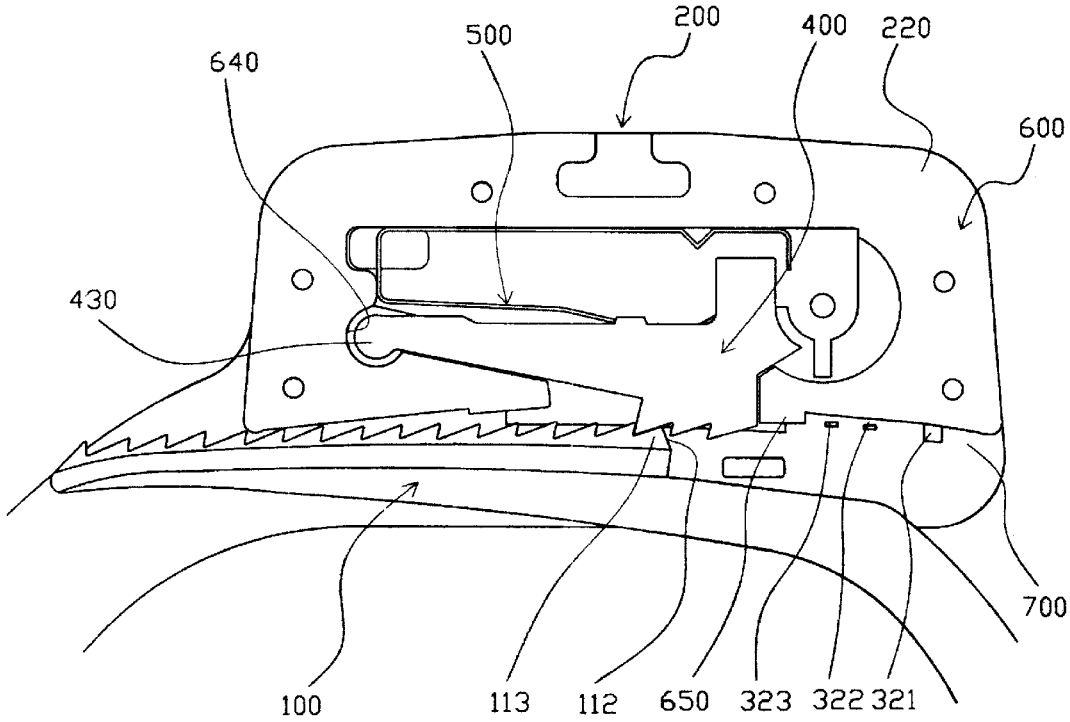
FIG. 3 is an enlarged view of the handcuff in which a blunt tooth of a movable arm is engaged with the innermost tooth of a pawl piece.
Figure 4:
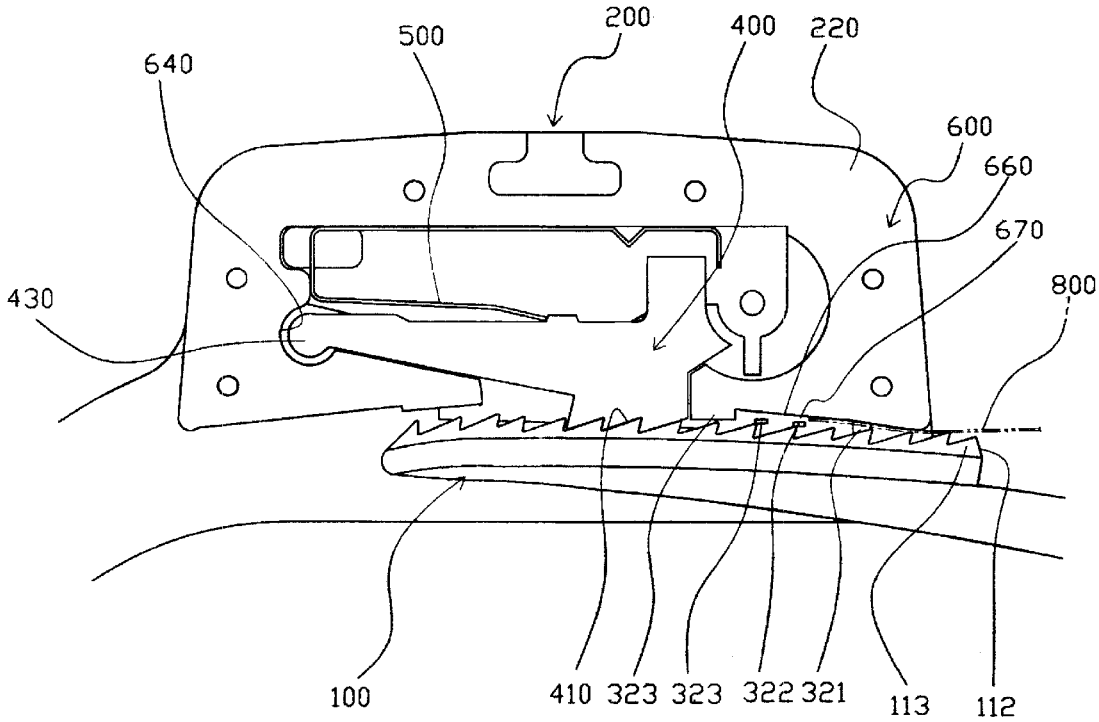
FIG. 4 is a view similar to FIG. 3, in which teeth of the movable arm are engaged with teeth of the pawl piece.

The pair of base bodies 220 houses the partition plate 300, the pawl pieces 400, the leaf spring 500 and the frame plates 600 therebetween, and are coupled to each other by coupling pins 240 to define a passageway 700 therebetween, so that the movable arm 100 is moved through the passageway 700, as illustrated in FIGS. 3 and 4.

Each of the frame plates 600 is formed into a rectangular shape, and has a central space 610 having an opening 620. The central space 610 is provided at its corner with a hinge groove 640 into which the pawl piece 400 is swingably fitted.

The frame plate 600 is circumferentially formed with pin holes 630, and the fixed arms 200 are also formed with pin holes 230 corresponding to the pin holes 630 of the frame plates 600, so that the coupling pins 240 are inserted into the pin holes 230 and 630.

Figure 2:
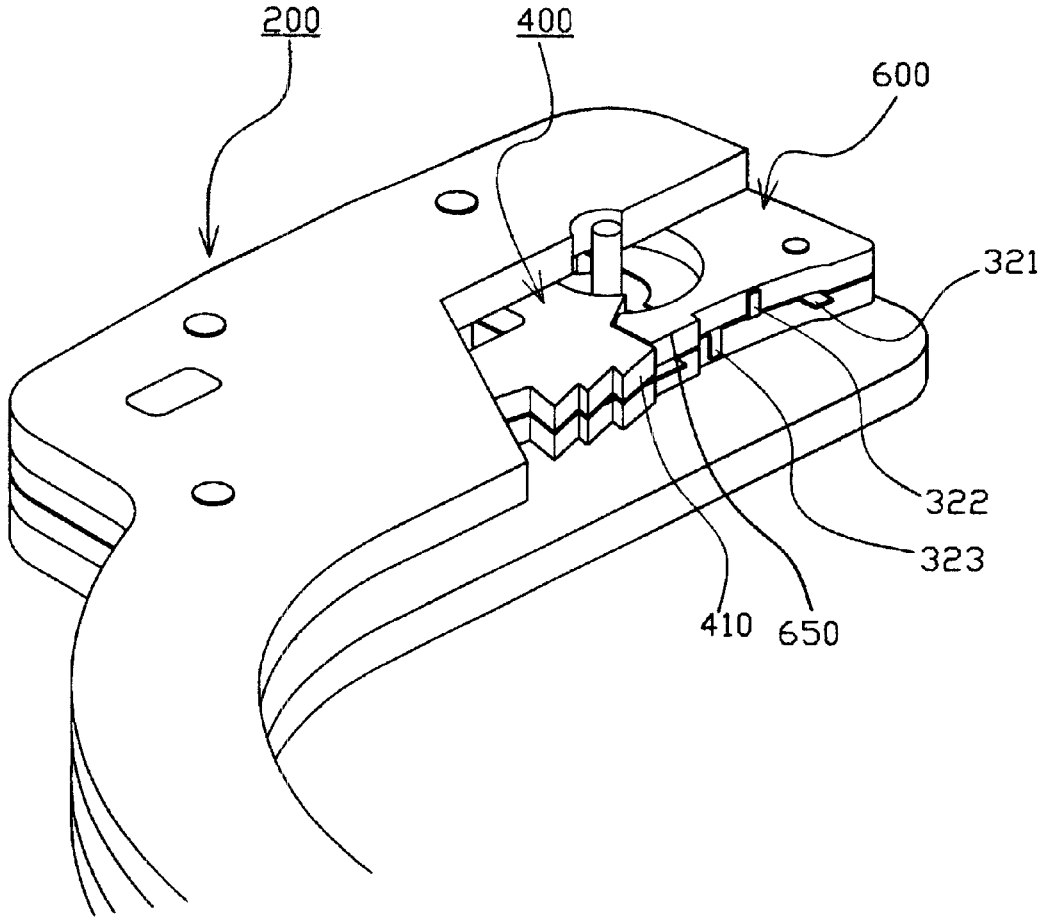
FIG. 2 is a perspective view of the handcuff according to the present invention, which is partially broken away.
Figure 5:
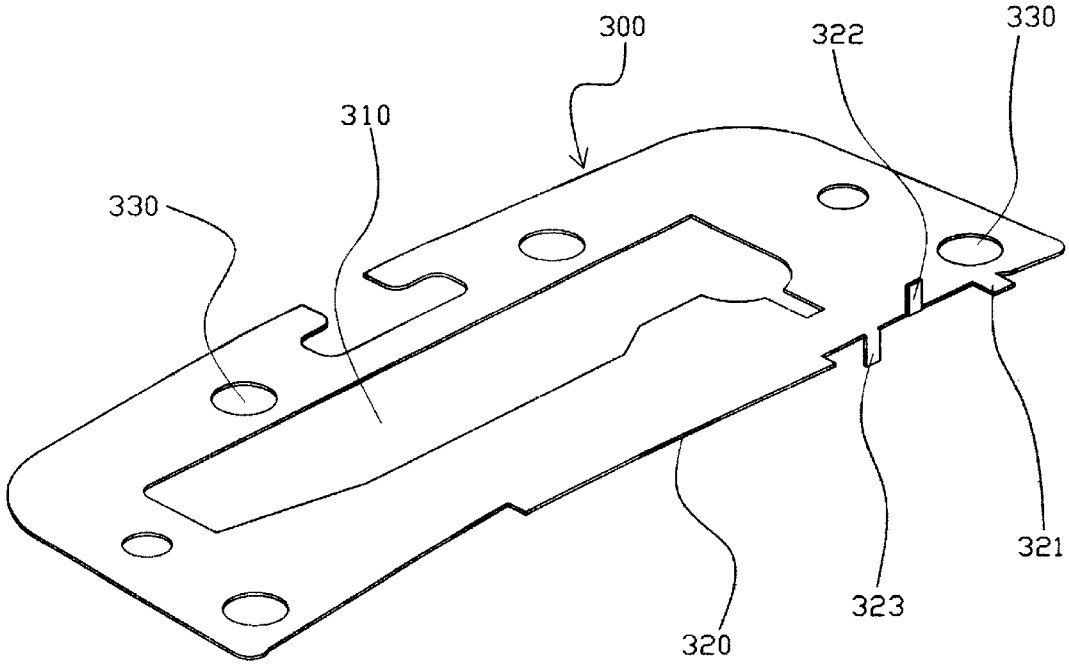
FIG. 5 is a perspective view of a partition plate according to the present invention.

As best seen from FIG. 2, the frame plate 600 is provided with an upwardly inclined surface 660 at a position corresponding to an inlet of the passageway 700, and is provided with a blocking protrusion 650 at an inner end of the upwardly inclined surface 660. As shown in FIG. 5, the partition plate 300 is provided with upward and downward bent protrusions 322 and 323 at positions adjacent to the dividing protrusion 321 such that there is a gap between the upward and downward bent protrusions 322 and 323 and the upwardly inclined surface 660 of the frame plate 600. Accordingly, a foreign metal object 800 introduced between the upwardly inclined surface 660 and the bent protrusions 322 and 323 is directed to the blocking protrusion 650.

More specifically, by the upwardly inclined surface 660 provided at the inlet of the passageway 700 of the frame plate 600, the foreign metal piece 800 is directed to pass over the ratchet portion 110 of the movable arm 100 and the bent protrusions 322 and 323 of the partition plate 300, and is then engaged to the blocking protrusion 650 of the frame plate 600. Therefore, it is possible to prevent the handcuff from being unlocked by a foreign metal object 800 introduced into the base bodies 220.

As shown in FIG. 3, the innermost tooth 113 of the ratchet portion 110 of the movable arm 100 is formed with a slanting surface 112 of a blunt tooth 113 so that the teeth 410 of the pawl piece 400 can pass over the slanting surface 112. Hence, the blunt tooth 113 of the movable arm 100 is maintained in engagement with the teeth 410 of the pawl piece 400.

The pawl piece 400 is formed into a hammer shape, and is provided at its end with a rounded hinge portion 430 which is fitted into the hinge groove 640 of the frame plate 600 so that the pawl piece 400 can be slightly swung about the hinge groove 640. The pawl piece 400 is also provided at the other end with a plurality of teeth 410 (three teeth being shown in the drawing) which are engaged with the teeth 111 of the movable arm 100. Furthermore, the pawl piece 400 is provided with a protrusion 420 on the opposite side of the teeth 410 such that an end of the leaf spring 500 is engaged to the protrusion 420. Therefore, the pawl piece 400 is biased toward the teeth 111 of the ratchet portion 110 of the movable arm 100 by the leaf spring 500.

As shown in FIGS. 3 and 4, the leaf spring 500 is formed into a "U" shape. The leaf spring 500 is in contact with a wall defining the space or reception cut portion 610 of the frame plate 600 at its one wing portion. The end of the other wing portion of the leaf spring 500 is slightly bent and engaged to the protrusion 420 of the pawl piece 400. Accordingly, the teeth 410 of the pawl piece 400 is biased toward the ratchet portion 110 of the movable arm 100.

The partition plate 300 is formed from a rectangular thin plate and is provided with a central rectangular space or reception cut portion 310. The partition plate 300 is circumferentially formed with pin holes 330 corresponding to the pin holes 230 and 630 of the base body 220 of the fixed arms 200 and frame plate 600, so that the coupling pins are inserted in the pin holes 230, 330 and 630.

The partition plate 300 is disposed between the base bodies 220 of the pair of fixed arms 200 to separate the pair of base bodies 220 from each other. Accordingly, two sets of frame plates 600 and pawl pieces 400 are disposed at both sides of the partition plate 300, respectively.

Since the two sets of frame plates 600 and pawl pieces 400 disposed at both sides of the partition plate 300 are the same in configuration and functions, only one set of frame plate 600 and pawl piece 400 are described, and a description of the other set of frame plate 600 and pawl piece 400 are omitted.

Since the two sets of frame plates 600 and pawl pieces 400 are separated from each other by the partition plate 300, when the teeth 410 of the pawl piece 400 disposed at one side of the partition plate 300 are engaged with the teeth 111 of the movable arm 100, the teeth 410 of the pawl piece 400 disposed at the other side of the partition plate 300 are also engaged with the teeth 111 of the movable arm 100 at a position corresponding to the engaging position of the teeth 410 of the pawl piece 400 disposed at the one side of the partition plate 300.

At this time, the guide protrusion 320 of the partition plate 300 serves to guide sliding movement of the ratchet portion 110 of the movable arm 100 in conjunction with the partition groove 120 of the ratchet portion 110.

By this guide of sliding motion of the movable arm 100, the movable arm 100 can move through the passageway 700. FIG. 4 shows the movable arm 100 inserted in the passageway 700, in which the teeth 111 of the ratchet portion 110 of the movable arm 100 are engaged with the teeth 410 of the pawl pieces 400. In this state, the movable arm 100 can be further moved leftward. When the movable arm 100 is pushed leftward, the teeth 111 of the ratchet portion 110 of the movable arm 100 can pass over the teeth 410 of the pawl pieces 400, as shown in FIG. 3.

At this time, since the pawl pieces 400 are pivotably supported in the pivot grooves 640 of the frame plates 600 and are biased toward the teeth 111 of the ratchet portion 110 by the leaf spring 500, the teeth 111 of the ratchet portion 110 of the movable arm 100 are moved leftward through the passageway 700 while overcoming the biasing force of the leaf spring 500.

On the other hand, when the movable arm 100 is pulled through the passageway 700 in a direction opposite to the insertion direction, i.e., rightward, the slanting surfaces 112 located at the front end of the ratchet portion 110 of the movable arm 100 pass over the rearmost teeth of the teeth 410 of the pawl pieces 400 so that the blunt teeth 113 of the movable arm 100 are engaged with the rearmost teeth 410 of the pawl pieces 400.

Accordingly, when a user carries the handcuffs on him, the movable arm 100 is moved in the direction of being pulled out, so that the blunt teeth 113 of the movable arm 100 are engaged with the rearmost teeth 410 of the pawl pieces 400 and are maintained in the provisionally engaged position by the slanting surface 112. Upon using the handcuffs, the movable arm 100 is quickly released from the above engaged position and the teeth 111 of the ratchet portion 110 of the movable arm 100 are engaged with the teeth 410 of the pawl pieces 400 and are maintained in the engaged position. Therefore, a user can quickly arrest a criminal.

Furthermore, the handcuffs according to the present invention do not permit a foreign metal object such as a metal wire and a hair pin to enter thereinto through the passageway 700, thus preventing unlocking by displacement of the pawl pieces.

As described above, the present invention provides handcuffs which include frame plates having upwardly inclined surfaces and blocking protrusions at an inlet of a passageway and a partition plate having bilaterally bent protrusions, so that a foreign metal object inserted into the passageway is directed over a ratchet portion of a movable arm and the bent protrusions and is engaged to the blocking protrusions. Therefore, the handcuffs according to the present invention can be protected from insertion of a foreign object and thus can maintain its firmly locked condition.

In addition, when a user carries the handcuffs on him, blunt teeth of the movable arm are engaged with the rearmost teeth of pawl pieces and are maintained in the engaged position by the slanting surface. In a case of using the handcuffs, since the movable arm is quickly released from the above engaged position and the teeth of the ratchet portion are engaged with the teeth of the pawl pieces and are maintained in the engaged position, a user can quickly arrest a criminal.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A handcuff comprising:

a movable arm formed into a "C" shape, which is provided at its free end with a ratchet portion formed with dual line of teeth;

a pair of fixed arms formed into a "C" shape, which are pivotably connected at free ends thereof to the other end of the movable arm by a pivot pin and are integrally provided at their other ends with rectangular base bodies;

a partition plate interposed between the pair of base bodies of the fixed arms to define a passageway allowing the movable arm to pass therethrough, and having a central reception cut portion, and which is provided with a dividing protrusion and bilaterally bent protrusions at an inlet of the passageway;

a pair of frame plates disposed between the pair of base bodies of the fixed arms and the partition plate, each of the frame plates having a reception cut portion, and which are provided with upwardly inclined surfaces and blocking protrusions at the inlet of the passageway such that a gap is defined between the bilaterally bent protrusions of the partition plate and the upwardly inclined surfaces, thereby guiding a foreign metal piece entered into the passageway to the blocking protrusions through the gap;

a pair of pawl pieces biasedly supported in the reception cut portions of the pair of frame plates, and which are provided at their free ends with teeth to be engaged with the teeth of the movable arm; and a leaf spring received in the reception cut portions of the pair of frame plates to bias the pair of pawl pieces toward the ratchet portion of the movable arm.

2. The handcuff as set forth in claim 1, in which, the most proximal teeth of the movable arm are formed with slanting surfaces for causing the proximal teeth to have an obtuse angle at their apex, whereby when the movable arm is pulled out of the base bodies of the fixed arms, the innermost teeth of the pawl pieces pass over the most proximal teeth of the movable arm, thereby maintaining engagement between the innermost teeth of the pawl pieces and the most proximal teeth of the movable arm.

* * * * *